United States Patent [19]

Blower

[11] Patent Number: 4,722,101

[45] Date of Patent: Feb. 2, 1988

[54] OPTICAL SYSTEM FOR PROTECTIVE HEADGEAR

[76] Inventor: David H. Blower, 19 Brookway Road, Charlton King's, Cheltenham, Gloucestershire, United Kingdom, GL53 8HD

[21] Appl. No.: 898,297

[22] Filed: Aug. 20, 1986

[30] Foreign Application Priority Data

Aug. 21, 1985 [GB] United Kingdom ..... 8520968

[51] Int. Cl.[4] ..... A42B 3/02; G02B 5/08

[52] U.S. Cl. ..... 2/422; 2/425; 350/638

[58] Field of Search ..... 2/422, 425; 350/638

[56] References Cited

U.S. PATENT DOCUMENTS

| | | | |
|---|---|---|---|
| 3,804,495 | 4/1974 | Rayow et al. | 350/638 X |
| 3,978,526 | 9/1976 | Mitchell et al. | 2/422 |
| 4,040,744 | 8/1977 | Schertz et al. | 350/638 X |
| 4,385,811 | 5/1983 | Nava | 350/638 |
| 4,398,799 | 8/1983 | Swift | 350/638 |

FOREIGN PATENT DOCUMENTS

| | | | |
|---|---|---|---|
| 1062289 | 4/1954 | France | 2/422 |
| 2303493 | 10/1976 | France | 2/422 |
| 2409021 | 7/1979 | France | 2/422 |

*Primary Examiner*—Louis K. Rimrodt
*Attorney, Agent, or Firm*—Kenyon & Kenyon

[57] ABSTRACT

A helmet includes an optical system presenting a rearward view to the wearer as an image below the wearer's horizontal line of sight and including a plurality of optical components arranged such that the image is viewed through a viewing component positioned adjacent to the wearer's forward line of sight and below the horizontal line of sight. The remaining components are positioned such that the optical path from the rearward view to the viewing component is routed around one side of the helmet. The optical system is housed in a "knock-off" unit and is sealed to prevent condensation. The helmet may be used by motorcyclists or security guards and provides a compact arrangement having a wide field of view.

11 Claims, 9 Drawing Figures

OPTICAL SYSTEM FOR PROTECTIVE HEADGEAR

BACKGROUND OF THE INVENTION

The present invention relates to protective headgear or helmets including optical systems to enable the wearer to see an image of the view to the rear of the wearer.

The need for such optical systems arises because protective headgear gives protection to the head from impact during an accident but its inherent bulk and weight reduces the wearer's awareness of the surroundings by restricting the field of vision and as importantly, by decreasing the ease with which the wearer can scan the view to the rear and to the sides.

This lack of awareness can be a problem when a helmet is worn by people engaged in a security role but it is particularly important when the helmet is worn by drivers of vehicles such as motorcycles. Improving the motorcyclist's awareness of the situation to the rear is a significant safety factor.

Previous patents, such as the British Pat. Nos. 2,057,159 A and 2,077,942 A have described optical systems which are too large and/or have fields of view which are too restricted for them to be of serious practical value, particularly to motorcyclists. It is an object of the present invention to overcome these limitations by achieving a good field of view to the rear of the wearer, giving an image of suitable size and quality, whilst keeping the device in a compact and practical form.

SUMMARY OF THE INVENTION

According to the present invention there is disclosed a protective helmet having an optical system for presenting a rearward view to the wearer as an image below the wearer's horizontal line of sight and including a plurality of optical components arranged such that the image is viewed through a viewing component positioned adjacent to the wearer's forward line of sight, and below the horizontal line of sight, the remaining components being positioned such that the optical path from the rearward view to the viewing component is routed around one side of the helmet.

Preferably the viewing component is arranged to be viewed at more than 15 degrees below the horizontal line of sight of the wearer and preferably is arranged to be viewed with a lateral angle of deflection from the forward line of sight of less than 50 degrees.

There are a number of reasons for preferring to look down, and some of these are given below:

It is more comfortable, and more natural, to look down, rather than up, and since a motorcyclist's head is generally inclined forward he is already looking above his natural horizontal line of sight. Looking down is therefore less of a strain on the eyes. The light path required to see the view to rear is also shorter than with the over the top systems, making it possible to reduce the size of the device for a given field of view. The viewing component which may conveniently be a mirror can be smaller, since it can be nearer to the eye, and be located in the chin guard area to have a minimal effect on peripheral vision. The optical system is also in a position which ls less likely to cause serious injury to the wearer in the case of an accident. At the same time it lends itself to the construction of a "knock off" arrangement and allows for the inclusion of padding to minimize the possibility of injury.

A further advantage of positioning the system below the horizontal line of sight is that it enables the conventional visor to be used without restriction.

Probably the most important reason for looking down to see the image of the view to the rear is that it enables the viewing mirror to be positioned well below the horizontal line of sight and still be in a position where it can be seen comfortably when "looked at" rather than be in a position where it is "seen" all the time as this can result in a feeling of disorientation. Obviously the rider will be aware of changes in the image through peripheral vision but not in such a way that the forward and rearward views are seen at the same time.

A pair of viewing systems may be used, one for each eye, and arrangements may be made to coordinate the systems in such a manner as to give binocular vision.

Preferably the optical system is provided with means of adjustment to permit alteration of the rear field of view and also to accommodate different eye positions and requirements. This may be done by adjusting the thickness of the helmet lining or by adjusting the viewing mirror. Means may also be provided to permit alteration of the rear field of view.

The optical system may include means of adjusting the light intensity to overcome problems caused by headlamps from following cars at night, or from low sun in summer, and could incorporate a photochromic element.

Care must be taken to avoid images which make the judgement of distance difficult and which are not properly focussed.

The device can be fitted as an attachment to a standard full face helmet or to a helmet with no chin guard if suitably modified.

If the mirrors are made from materials which tarnish, such as alumnised plastic, and to overcome problems caused by condensation and contamination, the optical system should be sealed with provision for an expansion facility, to compensate for changes in the contained gas pressure. Before sealing the system should be purged with a dried gas such as nitrogen.

Housing the optical system in a closed unit will eliminate problems caused by the misting up of the mirrors but care must be taken to avoid misting up the viewing window by suitable shielding and ventilation. Care must also be taken to angle the viewing window in such a manner that external reflections are avoided. This means that the "window" should be at an angle approaching 90° to the line of sight when looking at the viewing mirror.

Preferably the reflecting surfaces are metallised plastic, such as aluminised perspex, with the light being reflected from the metal surface directly and not after passing through the plastic substrate.

The view to the rear may cover a wide angle and is certainly not restricted to the view directly behind the wearer. The ability to see clearly to the rear and to be able to scan the view to the rear would be of great advantage to motorcyclists because of the inadequacy of the mirrors attached to most motorcycles. A further advantage would be that the image would be seen in a fixed position relative to the eye, thereby reducing the time taken to "find the image.

During attempts to make a compact device which allowed a wide angle of view to be seen it became apparent that plane mirrors are unsatisfactory if used alone because of the size of the system which is required, even for a small field of view. Tests have confirmed that a very much smaller, and therefore more practical, unit can be made by the use of non-planar mirrors. Non-planar lenses may also be used. The use of a plurality of optical components, which includes at least one non-planar mirror, or one non-planar lens, to enable a wider field of view to be seen in the viewing mirror which is situated below the horizontal line of sight is the basis of this application. This may alternatively be expressed as providing the optical system with an angular magnification of less than unity.

Non-planar mirrors and lenses may also be incorporated in optical systems having angular magnifications which are greater than or equal to unity as required but these are unlikely to be of interest to motorcyclists because of the limited field of view. Obviously the simplest way to achieve a magnification of unity is to use plane mirrors. Similarly a magnification of a little less than unity can be achieved by the use of plane mirrors with a single very long focus convex mirror, as currently used for rear view mirrors on vehicles, as the object mirror. Magnification of a little more than unity can then be obtained by the addition of a long focus concave mirror between the convex object mirror and the object.

Excellent images can be obtained when looking into the viewing mirror if it is a long focus concave mirror, or part of a long focus system, when the object mirror is a convex mirror with a shorter focal length that the viewing mirror/system. The convex object mirror gives a diminished image covering a wide field of view and this image is enlarged by the concave viewing mirror/-system. A convex lens may be used to replace the concave mirror and/or a concave lens may replace the convex mirror and still give a good image if properly focussed. When using lenses, lens combinations may be used to improve the image quality as in other optical devices.

The image can also be enlarged by interposing another long focus concave mirror between the convex object mirror and the object being viewed. A long focus convex lens can be used in a similar manner.

Another method of utilising non-planar mirrors in order to obtain a focussed image is to use two opposed concave mirrors. In this case the image will be rotated through 180° but the "correct" image will be restored by the use of a second pair of concave mirrors. A convex lens may be substituted for each concave mirror allowing a wide variety of combinations to be used and giving great design flexibility. Obviously account has to be taken of the fact that light passes through lenses but it is reflected by mirrors.

In order to utilise in this application non-planar mirrors, non-planar lenses, or combinations of these, it may be necessary to make use of a plane mirror, or mirrors.

BRIEF DESCRIPTION OF THE DRAWINGS

Details of these optical systems and their utilisation in preferred embodiments of this invention will be described, by way of example, with reference to the accompanying drawings in which.

DETAILED DESCRIPTION

Figure 1:
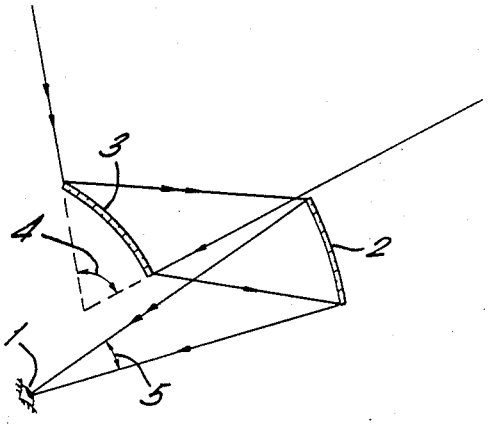
FIG. 1 shows a long focus concave viewing mirror and a convex object mirror.

Referring to FIG. 1 the eye at 1 sees an enlarged image in the concave long focus viewing mirror 2 by reflection from the diminished image in the convex object mirror 3. Both are spherical mirrors with the focal length of 2 being greater than that of 3 to obtain a focussed image. Angle 5 is less than angle 4 with a magnification of less than unity. If viewed in the opposite direction the magnification is greater than unity but with a much reduced field of vision.

Figure 2:
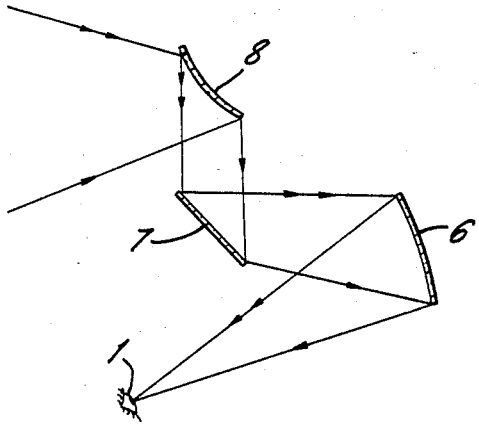
FIG. 2 shows an intermediate mirror situated between the mirrors in FIG. 1 making it more suitable for use in a safety helmet.

FIG. 2 is like FIG. 1 except that it has an intermediate mirror 7. Mirror 7 may be plane, although it could also be concave provided that the effective focal length of 6 and 7 is longer than that of 8. Similarly the viewing mirror 6 may be plane with the intermediate mirror 7 being concave and of long focus. Again the magnification is less than unity.

Figure 3:
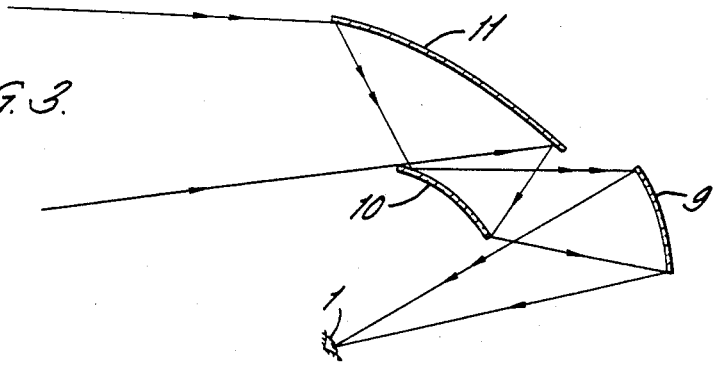
FIG. 3 is a further modification of FIG. 1 incorporating a second concave mirror.

FIG. 3 is again like FIG. 1 except that a long focus concave mirror 11 is used to enlarge the image seen by the eye at 1 in the viewing concave mirror 9. Mirror 10 is convex.

Figure 4:
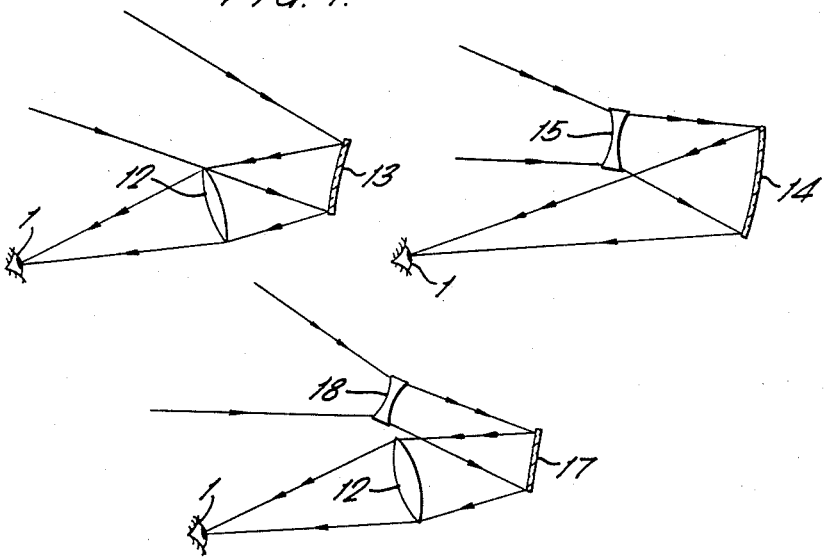
FIG. 4 shows further embodiments utilising non-planar lenses.

FIG. 4 is also based on the previous figures except that non-planar lenses are substituted for non-planar mirrors. The convex lens 12 is used in place of the concave mirror 2 in FIG. 1. Both arrangements can be made to give "correct" focussed images. In the second diagram the convex object mirror has been replaced by a concave lens 15 whereas in the third diagram both the concave and convex mirrors are replaced by a convex 12 and concave 18 lens and incorporates an intermediate plane mirror.

It will be seen that it is possible to substitute a long focus convex lens for a long focus concave mirror and that it is possible to substitute a short focus concave lens for a short focus convex mirror. This, coupled with intermediate mirrors, allows great variety in the optical arrangement which can be utilised.

Figure 5:
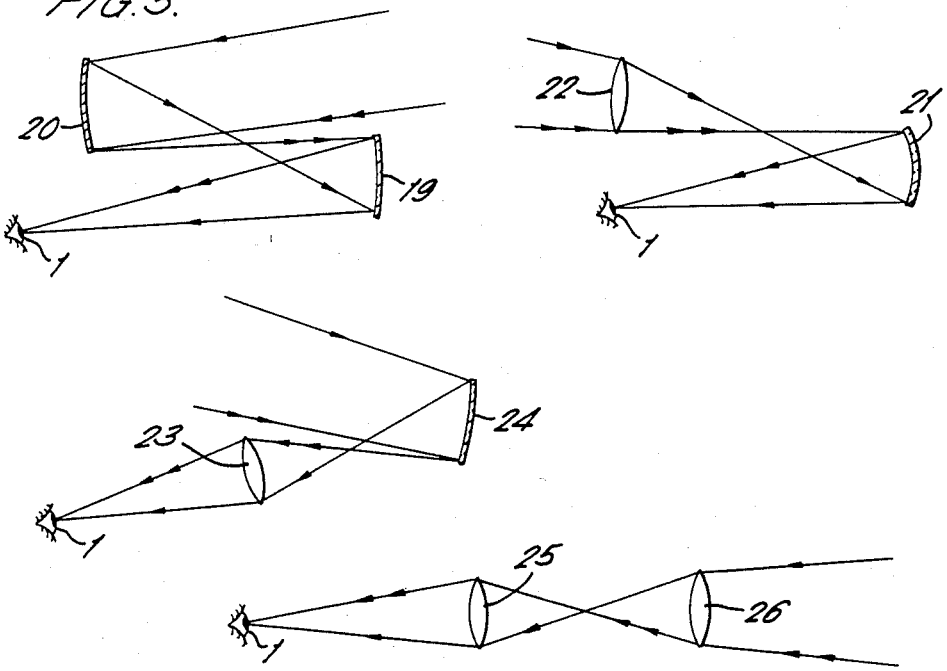
FIG. 5 indicates a pair of opposed concave mirrors which can be focussed to give an inverted image, together with modification, utilising non-planar lenses.

FIG. 5. Opposed concave mirrors 19 and 20 give a focussed image when viewed from 1 but it is rotated through 180° . A convex lens may be used to replace either or both of the concave mirrors as shown in the accompanying diagrams. Obviously none of the systems shown in FIG. 5 can be used on their own because of the rotated image but a pair of such optical arrangements can be made to give an excellent "correct" image. The distances between the optical elements depends on their focal length and different focal length elements can be utilised to give the required magnification/field of vision.

Figure 6:
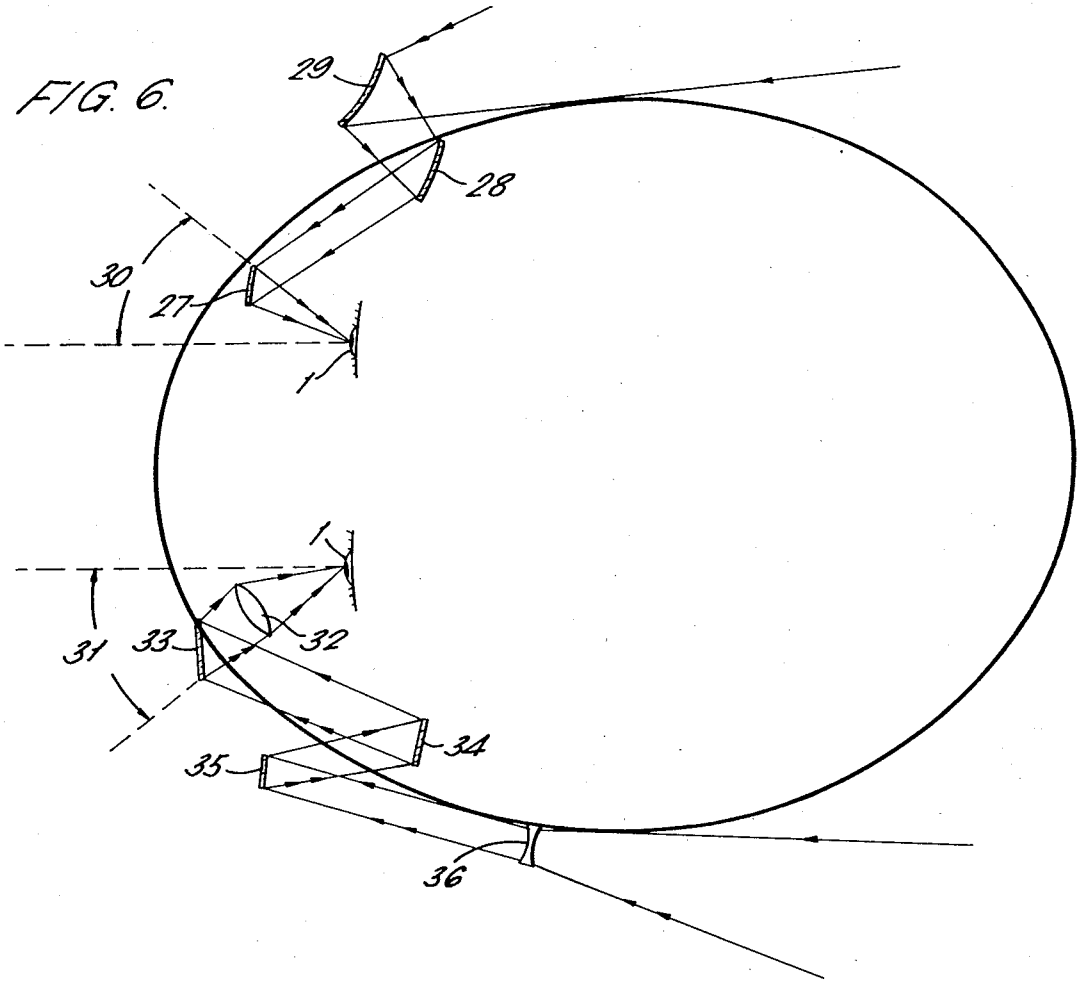
FIG. 6 shows embodiments utilising non-planar mirrors and non-planar lenses incorporated into a plan view of a motorcycle helmet.

FIG. 6 shows the plan-view of two embodiments incorporated into a motorcycle helmet.

In the left hand side of the helmet the viewing mirror 33 is seen through the convex lens 32 with eye at 1. Mirrors 33, 34 and 35 are plane mirrors while the wider field of view is obtained through the use of the concave lens 36.

Viewing mirror 27 is a long focus concave mirror as is 28 while the wide angle of view is obtained by utilising the short focus convex mirror 29. Either mirror 27 or mirror 28 can be a plane mirror as this will still effectively give a concave viewing system.

The angle 30 between the outside edge of the viewing mirror and the straight ahead line should be less than 50°.

Similarly the angle shown as 31 should be less than 50°.

Figure 7:
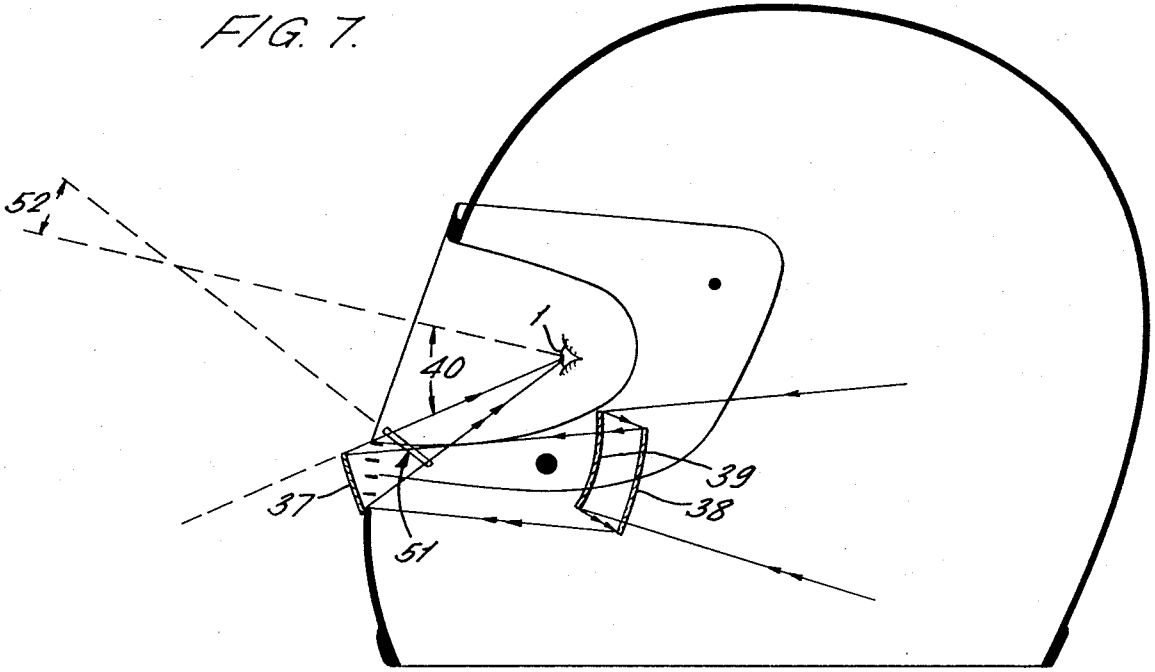
FIG. 7 shows a side schematic view of an embodiment of this invention incorporated into a safety helmet.

FIG. 7 is a side schematic view of the embodiment in FIG. 6 utilising mirrors. A good image can be obtained if the viewing mirror 37 is a concave mirror of radius 33 inches and the intermediate mirror 38 is a concave mirror of radius 22 inches with the convex object mirror having a radius of 6 inches. Similarly the viewing mirror 37 may be plane with the intermediate mirror 38 being a concave mirror of radius 11.2 inches and the convex object mirror having a radius of 6.0 inches or with a plane viewing mirror 37 the intermediate mirror 38 can be a concave mirror of radius 8.2 inches with the convex object mirror having a radius of 4.5 inches. The radii are approximate values.

The angle 40 which shows the angle between the top of the viewing mirror 37 and the horizontal line of sight should be more than 15° to avoid disorientation and restriction of peripheral vision. Preferably it should be over 30°. To conform with the British Standard BS6658/1985 it should be greater than 45° from the horizontal basic plane as defined by the Standard in order not to obstruct peripheral vision.

FIG. 7, which utilises a concave mirror to enlarge the image in the convex object mirror, is the preferred combination as it enables a compact unit to be made which can be constructed to "knock-off" the helmet in the event of an accident.

Figure 8:
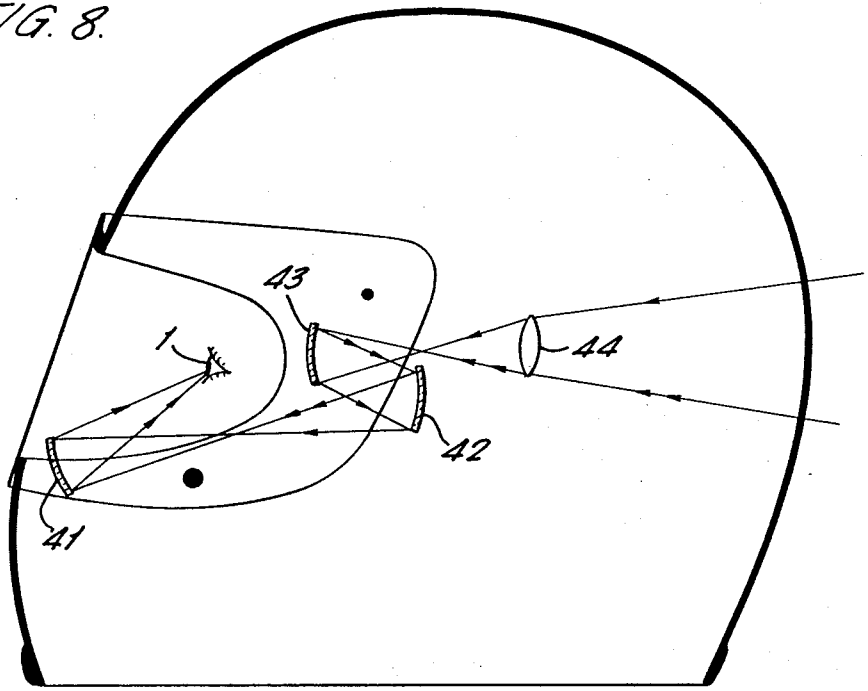
FIG. 8 shows a further side schematic view.

FIG. 8 is a further side schematic view which embodies a pair of opposed concave mirrors 41 and 42 which results in an inverted image which is corrected by the combination of concave mirror 43 and convex lens 44. The use of opposed concave mirrors is more critical as far as focussing and eye position are concerned and has the added disadvantage of being difficult to incorporate into a "knock-off" unit.

Figure 9:
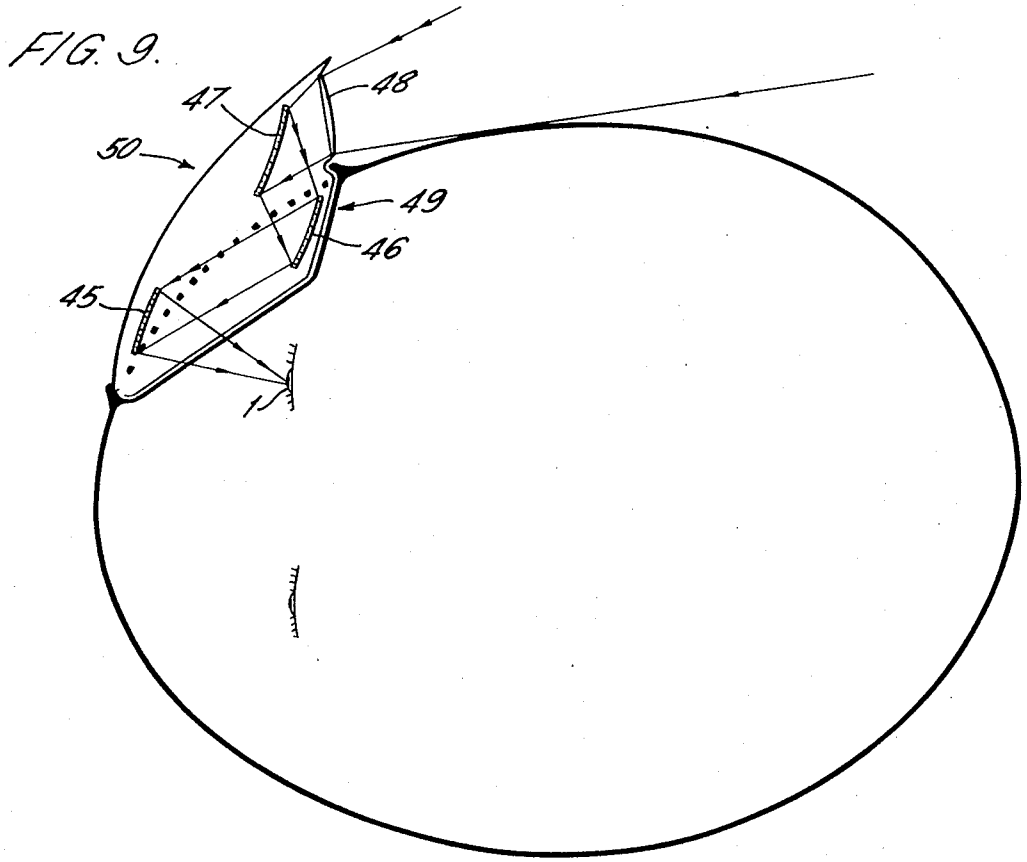
FIG. 9 indicates an embodiment incorporating a "knock-off" facility.

FIG. 9 is a plan view of the optical system utilised in FIG. 7 but in which the mirrors are housed in a "knock off" unit 50 which abuts the recessed shell of the helmet 49. The unit is sealed with the viewing window 51 being inclined towards the wearer by at least 20° above the horizontal line of sight in order to overcome unacceptable reflections from the window surfaces. Opportunity is taken to enlarge the image seen in the viewing mirror 45 by having a convex window 48 in the housing. Although the optical system housing is shown to be recessed into the chin guard it may be attached to the surface of a conventional chin guard as an accessory. The viewing mirror may then be seen by looking through the visor.

Although non-planar lenses have been shown in a number of the optical systems care would have to be taken in their use since even if they were plastic they are hard and may, if not very carefully housed, prove to be a safety hazard. The non-planar mirrors would preferably be spherical and could be of a metallised thin plastics material supported by a crushable backing. Properly housed these mirrors could be made crushable on impact and would therefore be generally safer to use than lenses.

A lower cost version of the arrangement shown in FIG. 7 could be made using plane mirrors with a corresponding reduction in the area seen which may be suitable for some applications. Similarly mirrors 37 and 38 could be plane mirrors with the object mirror 39 being a very long focus convex mirror as currently used for rear view mirrors on vehicles.

It will be seen that various embodiments of this invention are possible and that those skilled in the art will be able to design very compact optical systems to be utilised in motorcycle helmets without incurring a great weight or bulk penalty. Care would also have to be taken to streamline the envelope of the unit to reduce wind resistance and minimise wind noise caused by turbulence.

Although the optical system housing should be made to "knock-off" on impact the unit should be made less rigid than the helmet, particularly the recessed area, in order that the optical unit collapses more readily than the helmet under conditions of impact where the unit does not "knock-off" the helmet. To minimise this possibility the attachment of the unit to the helmet could be made fairly weak to assist the "knocking off" mechanism but this may then result in the unit sometimes being "knocked off" inadvertently. A connecting cord of limited strength and length could be used to connect the two components and allow the optical unit to be recovered and reattached.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A protective helmet comprising an optical system for presenting a rearward view to the wearer, said optical system comprising a plurality of optical components including a viewing component through which the image is viewed and which is positioned adjacent to the wearer's forward line of sight and below the horizontal line of sight, and remaining components of said optical system positioned such that the optical path from the rearward view to the viewing component is routed around one side of the helmet so as to present the view as an image below the wearer's horizontal line of sight.

2. A helmet as claimed in claim 1 wherein the viewing component is arranged to be viewed at more than 15 degrees below the horizontal line of sight of the wearer and with a lateral angle of deflection from the forward line of sight of less than 50 degrees.

3. A helmet as claimed in claim 2 wherein at least one of the optical components is selected to be a non-planar mirror or lens and the optical system has an overall angular magnification of less than unity so as to present a rearward view of greater field than that available using corresponding planar components.

4. A helmet as claimed in claim 3 wherein the viewing component is a concave viewing mirror and the optical path from the rearward view to the viewing mirror is routed via a convex mirror and a concave mirror respectively.

5. A helmet as claimed in claim 3 wherein the viewing component is a plane viewing mirror and the optical path from the rearward view to the viewing mirror is routed via a convex mirror and a concave mirror respectively.

6. A helmet as claimed in claim 1 which further comprises a unit in which the optical system is housed, which unit has a "knock off" facility whereby the unit is detachable from the helmet when knocked.

7. A helmet as claimed in claim 6 wherein the optical system is made suitable for the eye positions of different users by adjustment to the lining of the helmet.

8. A helmet as claimed in claim 7 wherein the optical system is sealed to prevent condensation with provision of an expansion facility to cope with changes of gas pressure.

9. A helmet as claimed in claim 8 wherein a viewing window is inclined towards the wearer by at least 20° above the horizontal line of sight.

10. An optical system for presenting a rearward view to the wearer of a helmet comprising a plurality of optical components including a viewing component through which the image is viewed and which is positioned adjacent to the wearer's forward line of sight and below the horizontal line of sight, and remaining components of said optical system positioned such that the optical path from the rearward view to the viewing component is routed around one side of the helmet so as to present the view as an image below the wearer's horizontal line of sight.

11. A helmet adapted for the attachment of an optical system for presenting a rearward view to the wearer comprising a plurality of optical components including a viewing component through which the image is viewed and which is positioned adjacent to the wearer's forward line of sight and below the horizontal line of sight, and remaining components of said optical system positioned such that the optical path from the rearward view to the viewing component is routed around one side of the helmet so as to present the view as an image below the wearer's horizontal line of sight.

* * * * *